US007610719B2

(12) United States Patent
Hsieh

(10) Patent No.: US 7,610,719 B2
(45) Date of Patent: Nov. 3, 2009

(54) ACTIVE BRAKE RELEASE DEVICE ATTACHED TO THE EXTERIOR OF A DOOR CONTROLLER

(76) Inventor: Chung Hsien Hsieh, 116 Fen-Liao Road Sec. 1, Lin-Kou Hsiang, Taipei Hsien (TW)

( * ) Notice: Subject to any disclaimer, the term of this patent is extended or adjusted under 35 U.S.C. 154(b) by 210 days.

(21) Appl. No.: 11/489,329

(22) Filed: Jul. 19, 2006

(65) Prior Publication Data

US 2008/0016977 A1 Jan. 24, 2008

(51) Int. Cl.
*E05D 13/00* (2006.01)

(52) U.S. Cl. ..... 49/322; 160/1; 160/4; 160/6; 160/9

(58) Field of Classification Search ..... 49/322; 160/1, 4, 6, 7, 9
See application file for complete search history.

(56) References Cited

U.S. PATENT DOCUMENTS 2,939,551 A * 6/1960 Hansen ..... 188/171
5,386,891 A * 2/1995 Shea ..... 188/171
5,743,320 A * 4/1998 McKeon ..... 160/310
5,850,865 A 12/1998 Hsieh
5,893,234 A * 4/1999 McKeon ..... 49/30
6,070,641 A * 6/2000 Budetti ..... 160/302
6,116,324 A * 9/2000 Leivenzon et al. ..... 160/310
7,281,612 B2 * 10/2007 Hsieh ..... 188/156
2006/0124249 A1 * 6/2006 Hsieh ..... 160/9
2006/0124250 A1 * 6/2006 Hsieh ..... 160/9

* cited by examiner

*Primary Examiner*—Jerry Redman
(74) *Attorney, Agent, or Firm*—Bucknam & Archer

(57) ABSTRACT

There is provided an active brake release device attached to the exterior of a door controller having a first electromagnet, in which a sliding portion can slide to activate a sliding bar when the first electromagnet is energized; a first and a second actuator, in which the first actuator is located to abut against the break release bar of the door controller, and a sliding pin of the first actuator is yieldingly biased in the anti-activation direction of the bar; and, the second actuator is limited by a limit means at a fixed position; a second electromagnet, which is used to release the second actuator when the second electromagnet is energized; and a circuit, which includes a limit-switch for switching on the first electromagnet upon resetting of the device and a capacitor which is used to temporarily supply power to the second electromagnet in an event of unexpected electricity failure. Thus, in the instant of unexpected electricity failure, the active brake release device will actively release the brake by a mechanical force, and shut off the safety door by sliding down with its own weight.

11 Claims, 4 Drawing Sheets

ACTIVE BRAKE RELEASE DEVICE ATTACHED TO THE EXTERIOR OF A DOOR CONTROLLER

TECHNICAL FIELD

This invention relates to an active brake release device, and particularly to an active brake release device attached to the exterior of a door controller, which can actively shut off the safety door in unexpected electricity failure.

BACKGROUND OF THE INVENTION

The conventional safety door, such as a fire door and an emergency door, consists of one or the other of these two types of systems based on the type of door controller, that is, the failsafe system and the non-failsafe system. As the safety door is usually used as a door access system for ordinary people, these two door controller systems both have their merits and demerits in usage depend on the user, (1) Failsafe system: In the situation of electricity failure, no matter what the reason is, the braking device of the door controller should immediately release the brake and shut off the safety door. In the event of a fire without electricity failure, the braking device will be released by cutting off the power by such as the smoke detector, temperature sensor, or other fire alarm detector, or through a fusible links melted in high temperature due to the fire and cutting off the power with a mechanical means, so that the safety door will slide down due to its own weight to be shut off. If the reason of electricity failure is definitely due to the fire, the device can stop the fire or exhaust of the smoke immediately after the fire. So, the system is preferred due to higher safety of fire protection. However, if the electricity failure is not due to a fire, the system will cause some inconvenience, and influence the normal entry/exit function. This should be the major defect. For example, the U.S. Pat. No. 5,850,865 belongs to the failsafe system category. In an event of unexpected electricity failure, the brake of this previous invention will actively be released after a delayed period, so the winding door will be fallen and shut off by its own weight.

(2) Non-failsafe system: In the situation of electricity failure for any reason, the braking device will turn into in braked status, and will not shut off the safety door immediately. After the fire-confirmation from the device such as the smoke detector, temperature sensor or other fire detecting devices, a back-up power source, such as a capacitor or battery, will temporarily supply current to the braking device to temporarily keep the brake releasing, or with a fusible links meted in high temperature under the fire to activate the braking device to release the brake by a mechanical means, so the safety door will be fallen due to its own weight and shut off. This type of system provides the advantage of not shutting off the safety door immediately after the electricity failure, if the reason of electricity failure is not due to fire, it will not prevent the user from passing through the door.

The conventional non-failsafe system, such as the baking device (91) of the door controller as shown in FIG. 1*a* and *b* (irrelevant components not shown), the braking device (91) uses a brake release bar (92) to activate the brake or release the brake. One end of the brake release bar (92) is yieldingly biased by a spring (94) to be constantly at brake state; and, the other end is extended outwardly. An electromagnet (93) is positioned in opposite to the spring (94), and it includes a sliding portion (93*a*) connected to the brake release bar (92). Normally, when the door controller is energized to operate; the electromagnet (93) is energized for magnetic excitation at the same time, which activates the brake release bar (92) through the sliding portion (93*a*) to release the brake. The brake will remain in the braked statue in de-energized condition. In the case of an unexpected electricity failure, and if this is due to a fire, by melting a fusible links (95) sensitive to the temperature by the high temperature due to the fire, the brake will be released by a push rod (95*b*) yieldingly biased by the spring (95*a*), and the safety door will be fallen due to its own weight and shut off. Those who are skilled in the art should understand that if the reason of electricity failure was indeed due to fire, and if the firing location is at a certain distance away from the fire detecting device or the fusible links, it could not shut off the safety door at the instant of fire. Thus, the insufficient safety for fire protection would be the main weakness of this system.

SUMMARY OF INVENTION

Due to the insufficient safety of fire protection for the non-failsafe door controller used in the safety door, the main object of the present invention is to provide an active brake release device that is attached to the exterior of the door controller, which could actively shut off the safety door in the event of an unexpected electricity failure to prevent the fire or exhaust of smoke from escaping at the first instant of fire, so as to enhance the safety of fire protection.

Another object of the present invention is to provide an externally attached brake release device, which could be attached to the current door controller and converts the passive fire protection into the active fire protection, so as to save the high cost from modification.

To this end, the active break release device attached to the door controller, including a braking device and a brake release bar extending outwardly, comprises: a first electromagnet, which is fixed on a base plate, with one end having a sliding portion; a first and second actuator, which can be activated by the sliding portion, and in which the first actuator is located at the position abutted against to the brake release bar, the second actuator having a cutoff portion; a sliding bar positioned in opposite to the first electromagnet, with one end connected to the sliding portion, and the other end yieldingly biased by a spring; a limit means, with one end pivoted on the base plate to swing, and the other end penetrated with a sliding pin and yieldingly biased by a spring to limit the cut-off portion of the second actuator at a fixed point; a second electromagnet, which has a sliding bar located at the position to abut against the sliding pin, for pushing the sliding pin sliding in the opposite direction during excitation; a circuit, including a limit-switch, for supplying power to the first electromagnet immediately during the resetting of the device; and, a capacitor, which is stored with a low voltage power, for temporarily supplying power to the second electromagnet to release the locked status of the second actuator, so as to use mechanical force to release the brake, so that the safety door will fall due to its own weight and shut off.

In this way, the safety door would be shut off actively at the instant in the event of an unexpected electricity failure, and if the reason of electricity failure is indeed due to fire, it can stop the fire or exhaust of smoke at the first instant of fire occurrence, so that the fire protection could be more active, and greatly enhancing the fire safety.

BRIEF DESCRIPTION OF DRAWINGS

The invention will be more clearly understood by the detailed description of the following embodiments in conjunction with the accompanied drawings, wherein.

DETAILED DESCRIPTION OF PREFERRED EMBODIMENTS

Firstly, the safety door of the present invention, such as the winding door lifting in the vertical direction or winding in the horizontal direction, is used as the safety door or the emergency door. The technical features of the invention will be further explained by the following embodiments. The embodiment is a preferred illustration only, should not be considered as a limitation of the application range of the present invention, which could be best appreciated by referring the drawings in conjunction with the following detailed description.

Figure 1B:
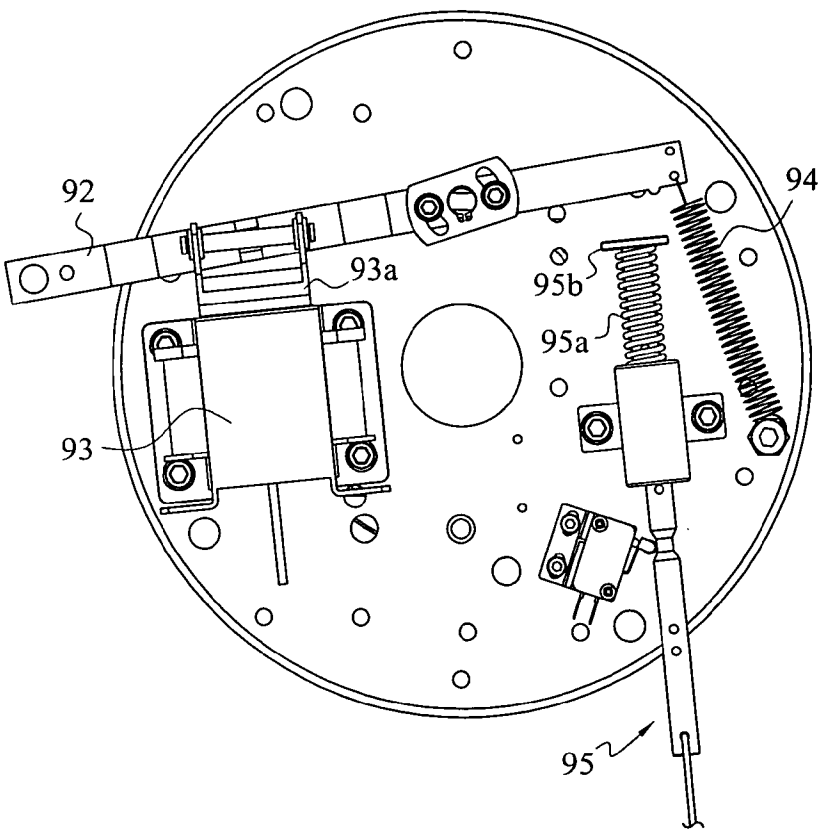
( PRIOR ART ) FIG. 1b
FIG. 1*b* shows the brake control device on the back of FIG. 1*a*, wherein the irrelevant components have been omitted.
Figure 1A:
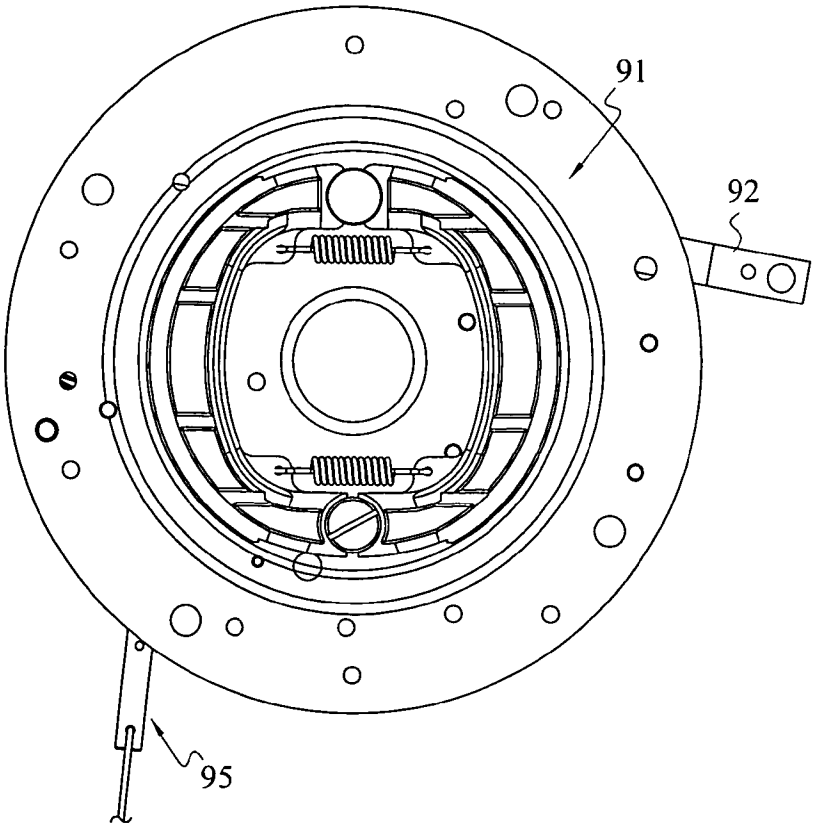
( PRIOR ART ) FIG. 1a
FIG. 1*a* shows the conventional brake device for the non-failsafe door controller, wherein the irrelevant components have been omitted.
Figures 2A, 2B:
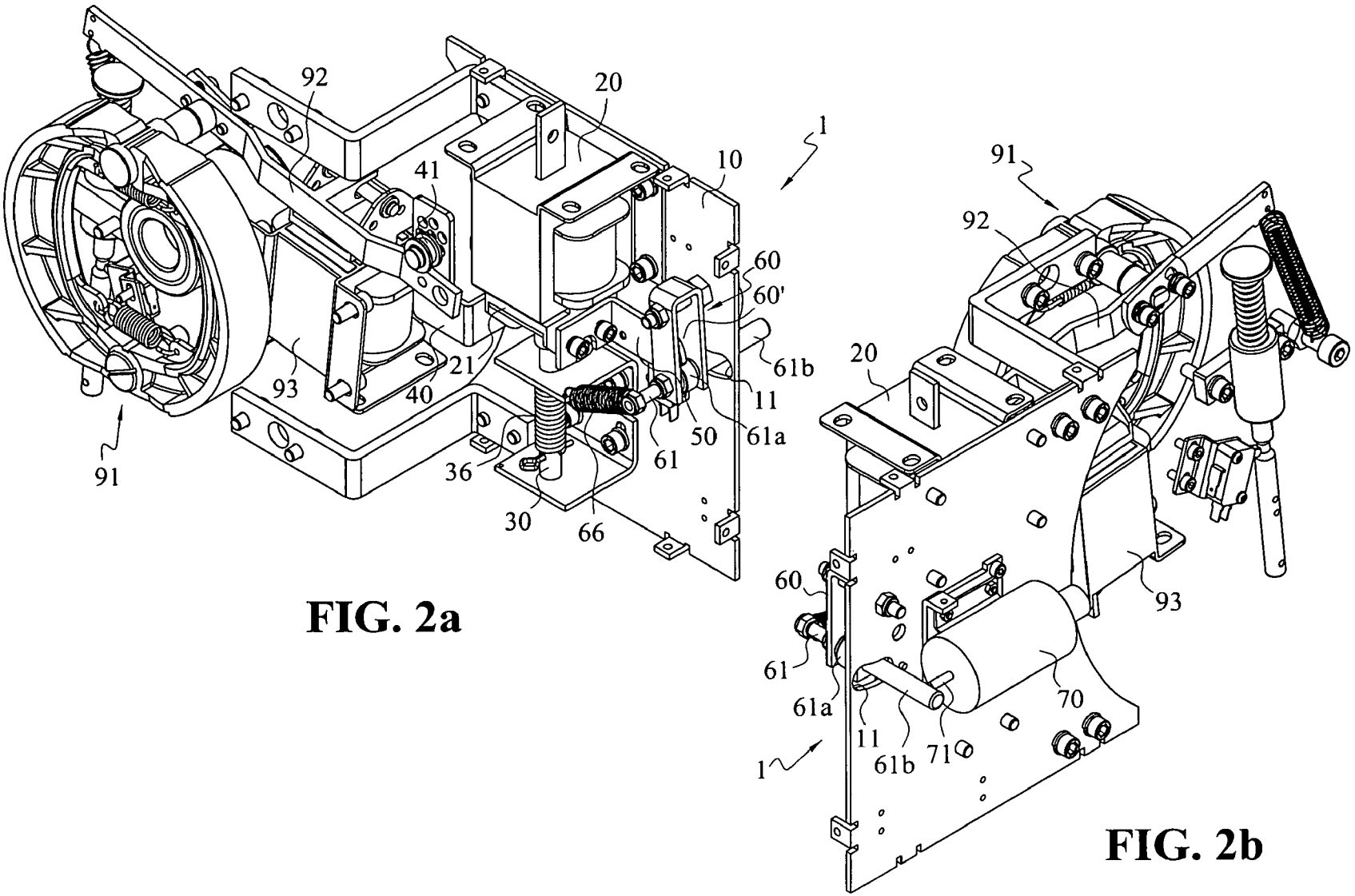
FIG. 2*a* is a perspective view of the active brake release device attached to the exterior of a door controller, wherein the other components have been omitted.
FIG. 2*b* is a perspective view of the structure on the back of FIG. 2*a*, wherein the other components have been omitted.
Figure 3:
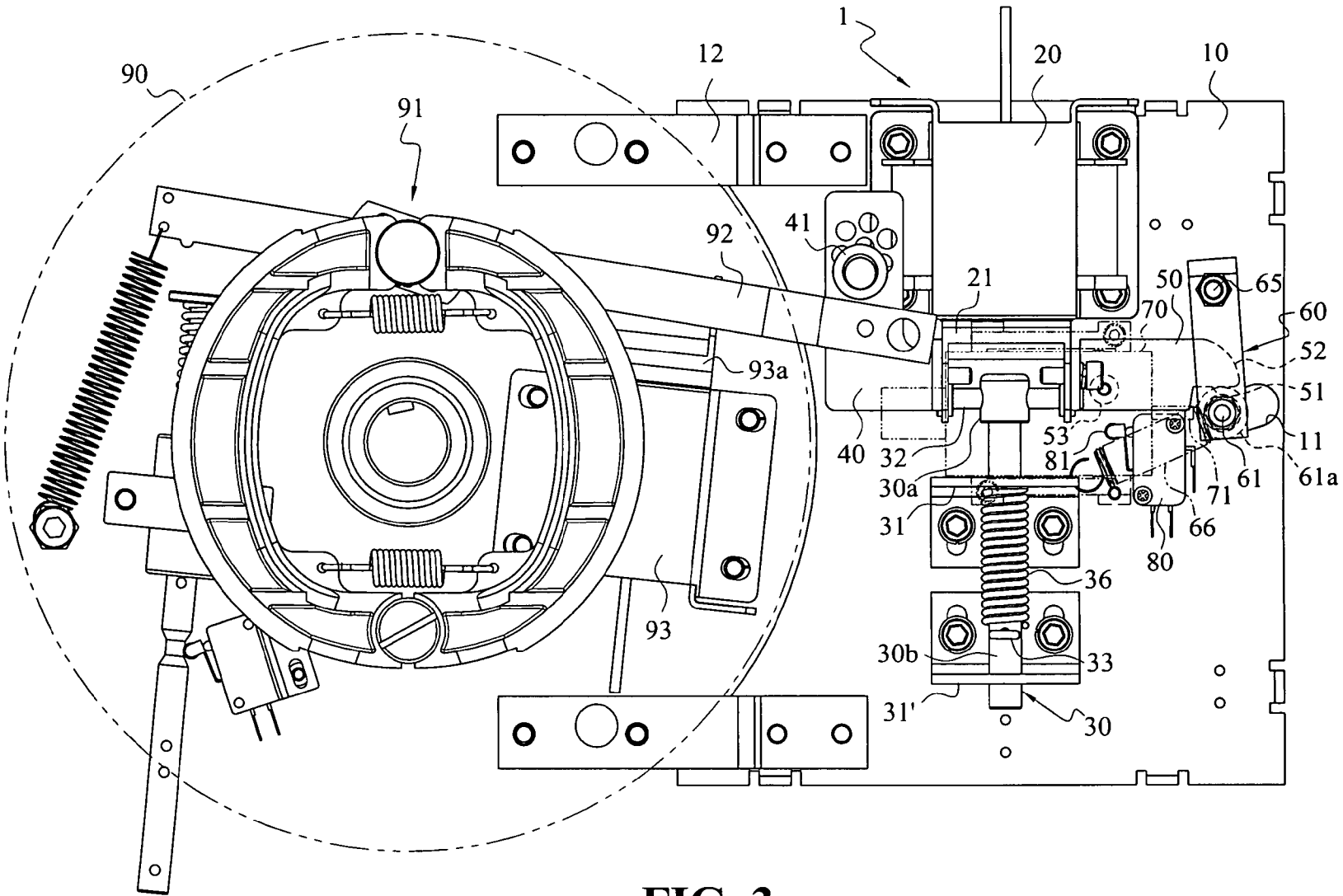
FIG. 3 shows a schematic plane view of the active brake release device attached to the exterior of a door controller according to the present invention, wherein the device is shown at the braked state.
Figure 4:
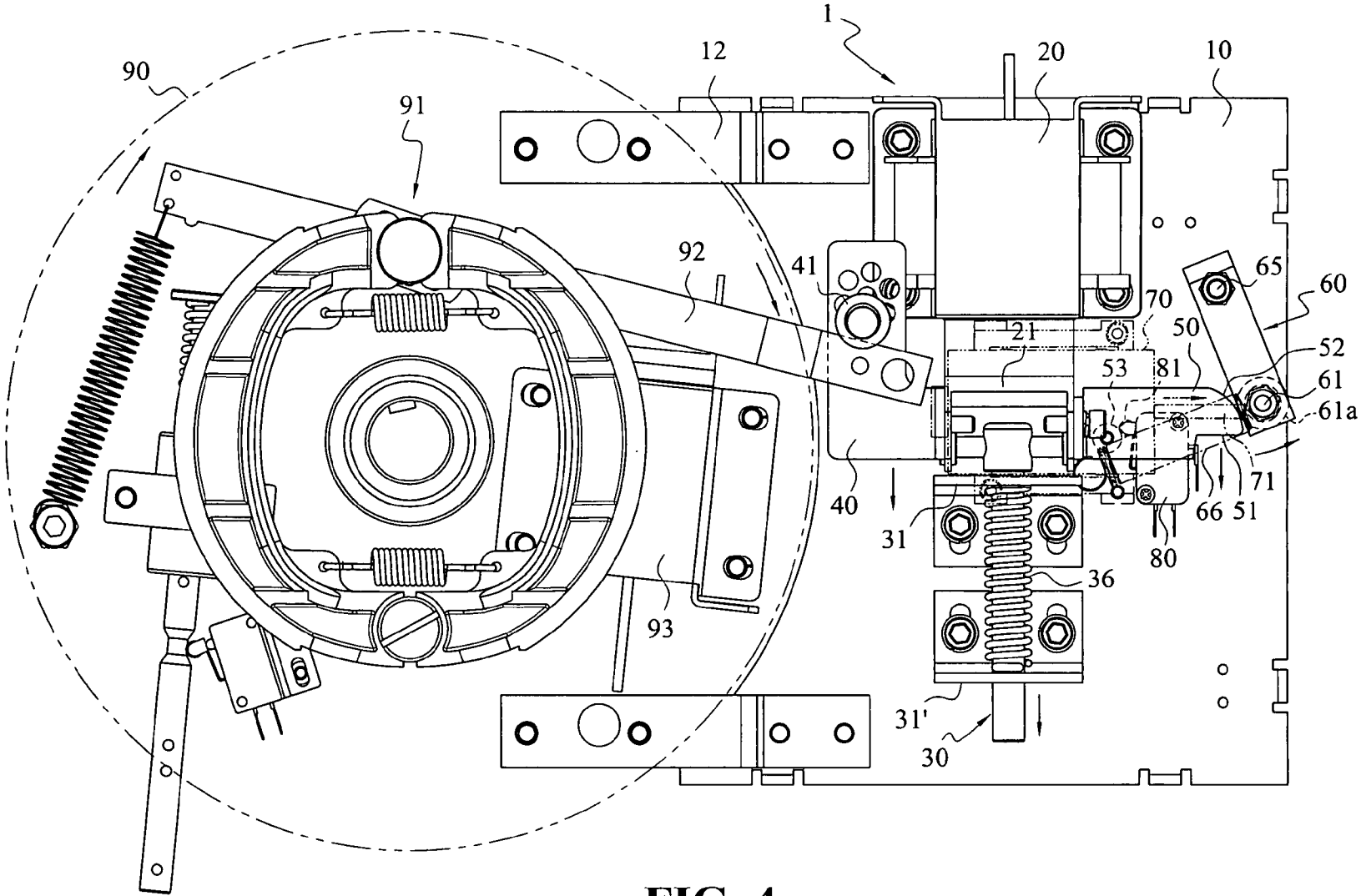
FIG. 4 shows a schematic plane view of the active brake release device attached to the exterior of a door controller according to the present invention, wherein the device is shown at the braked state.

FIGS. 2*a* and 2*b* show perspective view of the linking relationship between the active brake release devices attached to the exterior of the door controller and the door controller brake device according to the present invention. FIGS. 3 and 4 show the schematic plane views of the linking relationship between the active brake release device attached to the exterior of the door controller and the door controller brake device according to the present invention; wherein, FIG. 3 illustrates the braking state, and FIG. 4 illustrates the brake release state. For the convenience of description, the door controller (90) is represented only in imaginary lines, and the other irrelevant components have been omitted.

The active brake release device (1) attached to the exterior of the door controller according to the present invention comprises:

a door controller (90), having a braking device (91), which employs a break release rod 92 to activate the brake or release the brake; in which, one end of the brake release bar (92) is extended outwardly. Normally, when the door controller (90) is energized to operate, the electromagnet (93) is also energized for magnetic excitation at the same time, so as to activate the brake release bar (92) by the sliding portion (93*a*) of the electromagnet (93) to release the brake, and, the device will turn into at the braking state in de-energized condition;

a base plate (10), attached to the exterior of the door controller (90) by a plurality of supporting frames (12);

a first electromagnet (20), provided at a fixed point on the base plate (10), having a sliding portion (21) at one end, which is attracted to the side of the first electromagnet (20) during excitation;

a first actuator (40), one end of which being fixed to one side of the sliding portion (21) and linked with the sliding portion (21), and the other end of which being provided with a pulley (41) at the position abutted against the brake release bar (92);

a second actuator (50), one end of which being fixed to another side of the sliding portion (21) and also activated by the sliding portion (21), and the other end of which being formed with a notch on one side of the end to form a cut-off portion (51), and forming a guide portion (52) on the opposite side of the end guiding toward the notch direction;

a sliding bar (30), which could be guided by a pair of L-shaped guide plates (31, 31') for sliding, and being located on the opposite side of the sliding portion (21) of the first electromagnet (20), one end (30*a*) of said sliding bar (30) being connected with the sliding portion (21) through an axle pin (32), and the exterior of the other end being penetrated with a spring located between the pair of L-shaped guide plates (31, 31, and compression stroke of the spring 36 is limited by an insert pin (33) on the sliding rod (30);

a limit member (60), having an U-shaped structure, being provided with an accommodation space (60 , one end of which being pivoted on the base plate (10) through an axle pin (65) to swing, and the other end of which being a free end and penetrated with a sliding pin (61) in the vertical direction, and the outside of said one end of the sliding pin (61) being provided with a pulley (61*a*) located between the ends of the free ends of the limit means (60), and the other end of the sliding pin (61) being penetrated through the guiding slot (11) on the base plate (10) to form an extending end (61*b*), so that the sliding pin (61) is guided in the guiding slot (11) for sliding. A spring is constructed with one end hooked on the end of the sliding pin (61), and the other end hooked on the L-shaped guide plate (31), so that the free end of the limit means (60) is yieldingly biased with the trend constantly turning toward the direction of the second actuator (50), and, at the same time, the pulley (61*a*) on the sliding pin (61) is located at the position where the cut-off portion (51) of the second actuator (50) abuts against the guide portion (52);

a second electromagnet (70), as a low voltage electromagnet, being fixed on the back of the base plate (10), and having a sliding bar (71) located at a position to abut against the extended end (61*b*) of the sliding pin (61), being used to push the sliding pin (61) sliding toward the direction against the action of the spring (66) during energized state of said second electromagnet (70); and a circuit, comprising a limit-switch (80) for switching on the first electromagnet (20) at the moment of resetting the device (1); and, a capacitor (not shown in the diagram), for temporarily supplying power to the second electromagnet (70) in the event of an unexpected electricity failure.

According to the present invention, the second actuator (50) is further provided with a contact wheel (53) which is located at the position to pressed against the contact arm (81) of the limit-switch (80). When the device (1) is not reset, the contact wheel (53) is pressed against the contact arm (81) of the limit-switch (80) so as to make the circuit of the first electromagnet (20) closed (as shown in FIG. 4). Under the normal circumstance, when the device (1) is reset, the circuit will supply power to the first electromagnet (20) immediately through the circuit of the limit-switch (80), and activates the first actuator (40), the second actuator (50) and the sliding bar (30) sliding toward to the direction of the first electromagnet (20) at the instant of excitation. At this moment, the pulley (61*a*) of the sliding pin (61) on the fastener(60), due to the guiding effect of the guide portion (52) of the second actuator (50), will slide into the cut-off portion (51), and locking the end of the second actuator (50) in the accommodation space (60 (as shown in FIG. 3). At the same time, when the first electromagnet (20) is energized for the sliding portion (21) to slide, the contact wheel (53) on the second actuator (50) will immediately leave the contact arm (81) of the limit-switch (80), resulting in the open circuit of the first electromagnet (20). On the other hand, when the second actuator (50) is locked by the limit means (60), the pulley (41) of the first actuator (40) is located at the noncontact position abutted against the brake release bar (92). At the same time, the sliding bar (30)is yieldingly biased by the spring (36) so that the bar (30) have the inclination of sliding in opposite to the sliding direction of the sliding portion (21).

According to the present invention, the capacitor in the circuit stores the electricity under normal circumstances. In an event of unexpected electricity failure, no matter what the reason is, it will temporarily supply low voltage power to the second electromagnet (70). As indicated by the arrow in FIG. 4, when the second electromagnet (70) is energized, the sliding rod (71) will push the sliding pin (61) to sliding, resulting in the limit means (60) swinging in the direction against the action of the spring (66) to release the second actuator (50). At this time, the spring (36) on the sliding pin (30) is released, resulting in the sliding of the sliding pin (30) together with the sliding of the sliding portion (21) of the first electromagnet (20), the first actuator (40) and the second actuator (50) toward the direction of extending the spring (36); at the same time, making the pulley (41) on the other end of the first actuator (40) pushing the brake release bar (92) swinging toward the braking direction to release the brake, so that the safety door will be fallen due to its own weight, and shut off.

In conclusion, the active brake release device attached to the exterior of a door controller according to the present invention can easily convert the door controller on a safety door from the non-failsafe system to the failsafe system, and actively shut off the safety door in the event of any unexpected electricity failure. The present invention could make the fire safety protection more actively, which make it an innovative, progressive and commercial viable invention.

EXPLANATION OF MAIN COMPONENTS

1 Active brake release device
10 Base plate
11 Guiding slot
12 Supporting frame
20 First electromagnet
21 Sliding portion
30 First sliding bar
31 Guide plate
31' Guide plate
32 Axle pin
33 Insert pin
36 First spring
40 First actuator
41 First pulley
50 Second actuator
51 Cut-off portion
52 Guide portion
53 Contact wheel
60 Limit member
60' Accommodation space
61 Sliding pin
61*a* Second pulley
61*b* Extended end
65 Axle pin
66 Second spring
70 Second electromagnet
71 Second sliding bar
80 Limit-switch
81 Contact arm
90 Door controller
91 Brake device
92 Brake release bar
93 Electromagnet
93*a* Sliding portion

We claim:

1. An active brake release device (1) which is attached to an exterior of a door controller (90) and used to actively shut off a safety door in an event of unexpected electricity failure, wherein said door controller (90) winding said safety door is braked by a brake device (91) and released by a brake release bar (92) extending outwardly, said active brake release device (1) comprising:

a first electromagnet (20), which is fixed on a base plate (10) and placed on the exterior of the door controller (90), for activating a sliding portion (21) when the first electromagnet (20) is energized;

a first actuator (40) and a second actuator (50), which are linked to the sliding portion (21), in which the first actuator (40) is abutted against the brake release bar (92), and the second actuator (50) has a cut-off portion (51);

a first sliding bar (30), located on an opposite side of the first electromagnet (20), one end of which is connected with the sliding portion (21), and the other end of which is yieldingly biased by a first spring (36);

a limit means (60), one end of which is pivoted on the base plate (10) to swing, and the other end of which is vertically penetrated with a sliding pin (61) and is yieldingly biased by a second spring (66), used to limit the cut-off portion (51) of the second actuator (50) at a fixed point;

a second electromagnet (70), comprising a second sliding bar (71) for pushing the sliding pin (61) against a spring force of the second spring (66) when the second electromagnet (70) is energized;

a circuit, which includes a limit-switch (80) switching on the first electromagnet (20) upon resetting the active brake release device (1), and a capacitor which temporarily energizes the second electromagnet (70) in the event of unexpected electricity failure.

2. An active brake release device (1) as claimed in claim 1, wherein said first sliding bar (30) is guided by a pair of L-shaped guiding plates (31, 31') for sliding, and said first spring (36) through which said first sliding bar (30) penetrates is located between said two guiding plates (31).

3. An active brake release device (1) as claimed in claim 1, wherein one end of said first actuator (40) is fixed on said sliding portion (21), and the other end is provided with a first pulley (41) for abutting against the brake release bar (92).

4. An active brake release device (1) as claimed in claim 3, wherein one end of said second actuator (50) is fixed on the sliding portion (21), and the other end of said second actuator (50) is formed with said cut-off portion (51) and guide portion (52).

5. An active brake release device (1) as claimed in claim 4, wherein said limit means (60) is a U-shaped structure, said sliding pin (61) penetrates through a second pulley (61*a*) which is accommodated between both ends of the limit means (60), the second pulley (61*a*) being used to abut against the cut-off portion (51) and guided by the guide portion (52) of said second actuator (50).

6. An active brake release device (1) as claimed in claim 5, wherein the sliding pin (61) further includes an extended end (61*b*), which passes through a guiding slot (11) formed on the base plate (10), and is guided in the guiding slot (11).

7. An active brake release device (1) as claimed in claim 1, wherein the second actuator (50) is further provided with a contact wheel (53) for abutting against a contact arm (81) of the limit-switch (80).

8. An active brake release device (1) as claimed in claim 7, wherein the contact wheel (53) is pressed against the contact arm (81) of the limit-switch (80) during non-reset of the active brake release device (1), so as to close the circuit of the first electromagnet (20).

9. An active brake release device (1) as claimed in claim 8, wherein, when the first electromagnet (20)is energized, the contact wheel (53) will leave the contact arm (81) of the limit-switch (80) so as to switch off the first electromagnet (20).

10. An active brake release device (1) as claimed in claim 9, wherein the second electromagnet (20) is a low voltage electromagnet.

11. An active brake release device (1) as claimed in claim 1, wherein the safety door is either a fire door or an emergency door.

* * * * *

UNITED STATES PATENT AND TRADEMARK OFFICE

CERTIFICATE OF CORRECTION

PATENT NO. : 7,610,719 B2
APPLICATION NO. : 11/489329
DATED : November 3, 2009
INVENTOR(S) : Chung Hsien Hsieh It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 317 days.

Signed and Sealed this

Twelfth Day of October, 2010

David J. Kappos

David J. Kappos
*Director of the United States Patent and Trademark Office*